US009520097B2

(12) United States Patent
Takamaru et al.

(10) Patent No.: US 9,520,097 B2
(45) Date of Patent: Dec. 13, 2016

(54) DISPLAY DEVICE WITH COMPENSATING BACKLIGHT DRIVE CIRCUIT AND METHOD FOR DRIVING SAME

(71) Applicant: Sharp Kabushiki Kaisha, Osaka-shi, Osaka (JP)

(72) Inventors: Yutaka Takamaru, Osaka (JP); Seiji Kaneko, Osaka (JP); Yasuyuki Ogawa, Osaka (JP); Kaoru Yamamoto, Osaka (JP); Kohhei Tanaka, Osaka (JP); Seiichi Uchida, Osaka (JP); Noriaki Yamaguchi, Osaka (JP); Shigeyasu Mori, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 71 days.

(21) Appl. No.: 14/351,613

(22) PCT Filed: Oct. 31, 2012

(86) PCT No.: PCT/JP2012/078118
§ 371 (c)(1),
(2) Date: Apr. 14, 2014

(87) PCT Pub. No.: WO2013/069515
PCT Pub. Date: May 16, 2013

(65) Prior Publication Data

US 2014/0267464 A1 Sep. 18, 2014

(30) Foreign Application Priority Data

Nov. 7, 2011 (JP) ..... 2011-243165

(51) Int. Cl.
*G09G 3/36* (2006.01)
*G09G 3/34* (2006.01)

(52) U.S. Cl.
CPC ..... *G09G 3/3648* (2013.01); *G09G 3/3406* (2013.01); *G09G 3/3614* (2013.01);
(Continued)

(58) Field of Classification Search
CPC ..... G09G 2310/0237; G09G 2320/0247; G09G 2320/0626; G09G 3/3406; G09G 3/3614
(Continued)

(56) References Cited

U.S. PATENT DOCUMENTS

2002/0044116 A1* 4/2002 Tagawa ..... G09G 3/3406 345/87
2006/0125742 A1* 6/2006 Sekiguchi ..... G09G 3/3406 345/80
2011/0157247 A1* 6/2011 Tanaka ..... G09G 3/3426 345/690

FOREIGN PATENT DOCUMENTS

JP 2006-178435 A 7/2006

OTHER PUBLICATIONS

Official Communication issued in International Patent Application No. PCT/JP2012/078118, mailed on Jan. 8, 2013.

* cited by examiner

*Primary Examiner* — Ram Mistry
(74) *Attorney, Agent, or Firm* — Keating & Bennett, LLP

(57) ABSTRACT

In a display control circuit (200) of a display device, an image pattern detection portion (230) detects whether an image is an anti-flicker pattern or not, and when it is an anti-flicker pattern, a backlight source is driven (typically, such that its luminance changes in the opposite phase relative to luminance changes that would occur), on the basis of predicted values, which are predetermined so as to compensate for the luminance changes that would occur. Moreover, the backlight is not turned on during the scanning
(Continued)

period. As a result, flicker due to current leakage, etc., can be reduced or eliminated in a display device for which a scanning period and a scan stop period are set.

12 Claims, 8 Drawing Sheets

(52) U.S. Cl.
CPC ..... *G09G 2310/0237* (2013.01); *G09G 2320/0247* (2013.01); *G09G 2320/0626* (2013.01); *G09G 2360/16* (2013.01)

(58) Field of Classification Search
USPC ..... 345/99, 55, 84, 38, 39, 50; 349/98, 99
See application file for complete search history.

DISPLAY DEVICE WITH COMPENSATING BACKLIGHT DRIVE CIRCUIT AND METHOD FOR DRIVING SAME

TECHNICAL FIELD

The present invention relates to an active-matrix display device including a backlight illumination device that can be controlled so as to blink on and off, and a method for driving the same.

BACKGROUND ART

In general liquid crystal display devices, polarity inversion drive is performed in order to suppress liquid crystal deterioration and maintain display quality. However, inactive liquid crystal display devices, switching elements, such as TFTs (Thin-Film Transistors), which are provided for respective pixels, are characteristically insufficient to make the transmittance of the liquid crystal layer completely symmetrical with respect to positive and negative data voltages even if the polarities of video signals outputted by a video signal line driver circuit (also referred to as a "column electrode driver circuit" or a "data driver circuit"), which applies voltages to video signal lines (column electrodes) on the liquid crystal panel, are symmetrical, i.e., even if the polarities of applied voltages relative to the potential of a common electrode are symmetrical. Accordingly, in a polarity inversion drive scheme in which the polarity of a voltage applied to the liquid crystal is inverted (with respective to the potential of the common electrode) every frame (frame inversion drive scheme), flicker occurs in a displayed image on the liquid crystal panel (such flicker will be also referred to below as "flicker due to peak-to-peak asymmetry"). Recently, in particular, mobile information devices, such as cell phones, are required to have a high-quality display capability because of improvements to their processing performance and sophistication of their use, and therefore, such flicker due to peak-to-peak asymmetry becomes a problem. Accordingly, in a polarity inversion drive scheme employed for a liquid crystal module used in such a mobile information device, the polarity of an applied voltage is inverted every horizontal scanning signal line and also every frame (such a scheme is called a "line inversion drive scheme"). Moreover, in another polarity inversion drive scheme to be employed similarly, the polarity of an applied voltage is inverted every two vertically/horizontally adjacent pixels and also every frame (such a scheme is called a "dot inversion drive scheme").

However, in the case where the line inversion drive scheme is employed, while high-quality display can be achieved, the frequency of polarity inversion of a video signal to be applied to the liquid crystal panel increases (the inversion frequency becomes higher), and the frequency at which to change the potential of the common electrode also becomes higher in order to reduce the voltage a driver IC (Integrated Circuit) is required to withstand. This results in increased power consumption. In addition, in the case where the dot inversion drive scheme is employed, inversion drive of the common electrode is not possible, so that the driver IC is required to withstand a higher voltage. This leads to increased device production cost and increased power consumption.

Therefore, in some drive schemes employed in recent years, the overall inversion frequency is reduced by providing scan stop periods in order not to change applied voltages for predetermined periods (see, for example, Japanese Laid-Open Patent Publication No. 2006-178435). By inserting such scan stop periods (hold off periods), it is rendered possible to meet the requirements for low power consumption in cell phones and suchlike.

The longer the scan stop period is set, the more power consumption is reduced, but during the scan stop period, current leakage occurs in capacitive elements, which are provided in pixel forming portions on the liquid crystal panel in order to hold applied voltages, so that the voltages to be held are reduced. As a result, the luminance of pixels to be displayed in accordance with the next voltages to be applied changes conspicuously (although the luminance should remain the same). Consequently, such luminance changes are visually recognized as flicker (such flicker will also be called "flicker due to current leakage" below).

Furthermore, during a scanning period, the pixel forming portions on the liquid crystal panel are sequentially selected row-by-row, and pixel voltages are applied thereto. At this time, a predetermined period of time (within a selected period) is taken until the pixel voltage of each pixel forming portion reaches the level of the voltage applied thereto, i.e., until data writing is completed, and if the voltage changes during that period by virtue of parasitic capacitance, the luminance of the displayed pixel changes as well. If such amounts of luminance change vary, for example, between frames, flicker might be visually recognized (such flicker will also be called "flicker due to data writing" below).

Furthermore, during the scanning period, data is written to selected pixel forming portions, and thereafter, scanning signal lines and video signal lines coupled to adjacent or neighboring pixel forming portions might change in potential, so that the applied and held voltage might change by virtue of parasitic capacitance created between (pixel electrodes at one end of) capacitive elements in the pixel forming portions and the signal lines (this phenomenon will also be called "drawing due to parasitic capacitance"). As a result, the luminance of pixels to be displayed in accordance with the next voltages to be applied changes conspicuously. Consequently, such luminance changes are visually recognized as flicker (such flicker will also be called "flicker due to drawing" below).

Note that the flicker due to data writing and the flicker due to drawing occur conspicuously in actuality because of differences in pixel voltages between two adjacent frames, which are caused when polarity inversion drive is performed, but they are described herein as being different from the aforementioned flicker due to peak-to-peak asymmetry.

In this regard, Japanese Laid-Open Patent Publication No. 2006-178435 discloses the configuration of a liquid crystal display device in which a backlight device is caused to blink on and off so fast as not to be visually detectable during both scanning periods and scan stop periods, and the duration for which the backlight device is kept off during the scanning period is set longer than the duration for which the device is kept on, thereby reducing flicker.

CITATION LIST

Patent Document

Patent Document 1: Japanese Laid-Open Patent Publication No. 2006-178435

SUMMARY OF THE INVENTION

Problems to be Solved by the Invention

The configuration described in Japanese Laid-Open Patent Publication No. 2006-178435 renders it possible to reduce both flicker due to data writing and flicker due to drawing, but flicker due to current leakage cannot be reduced. Moreover, as described above, the direction of luminance changes caused by data writing and drawing is opposite between two adjacent frames, and therefore, in the above conventional configuration also, such luminance changes might be recognized as flicker. Accordingly, this conventional configuration might not be able to sufficiently reduce overall flicker caused by various factors as mentioned above.

In particular, the dot inversion drive scheme allows spatial averaging of the luminance changes, so that flicker as mentioned above can be reduced, but typically, in the case where a specific display pattern (e.g., a checkered pattern) is presented such that pixels that are vertically/horizontally adjacent to each other with one intervening pixel therebetween are equal in display tone, luminance changes occur frame by frame. Such a particular display pattern is called an anti-flicker pattern, and it is known that, in the case where such a display pattern is presented, flicker becomes more recognizable, particularly in the aforementioned conventional configuration.

Therefore, an objective of the present invention is to provide a display device capable of setting a scanning period and a scan stop period (hold off period) and reducing or eliminating both flicker due to current leakage and flicker due to data writing and drawing.

Solution to the Problems

A first aspect of the present invention is directed to an active-matrix display device provided with a backlight including a light source, a plurality of pixel forming portions for forming an image to be displayed by transmitting light from the light source, a plurality of video signal lines for transmitting a plurality of video signals representing the image to be displayed to the pixel forming portions, and a plurality of scanning signal lines crossing the video signal lines, the pixel forming portions being arranged in a matrix so as to be associated with the video signal lines and the scanning signal lines, the device comprising:

a scanning signal line driver circuit for selectively driving the scanning signal lines during a predetermined scanning period and deselecting all of the scanning signal lines during a hold off period starting upon completion of the scanning period, the scanning period and the hold off period constituting a frame period longer than 1/60 of a second;

a video signal line driver circuit for providing the video signal lines with the video signals to be transmitted, during the scanning period;

a backlight drive circuit for controlling the light source included in the backlight so as to be turned on/off; and a luminance change storage portion having prestored therein predicted values for luminance changes in an image to be displayed by the pixel forming portions during the hold off period, wherein, the backlight drive circuit calculates emission luminance of the light source on the basis of the predicted values stored in the luminance change storage portion, and controls the light source so as to be turned on with the calculated emission luminance, thereby compensating for the luminance changes.

In a second aspect of the present invention, based on the first aspect of the invention, the display device further includes a pattern detection portion for determining whether or not at least a part of the image matches a prestored display pattern, the luminance change storage portion has stored therein predicted values for luminance changes corresponding to display patterns detectable by the pattern detection portion, and when the pattern detection portion determines a match, the backlight drive circuit calculates and controls the emission luminance of the light source on the basis of predicted values stored in the luminance change portion and corresponding to a display pattern determined as the match.

In a third aspect of the present invention, based on the second aspect of the invention, the video signal line driver circuit performs drive such that the video signals transmitted to the pixel forming portions are inverted in polarity every frame period and also every one or more rows corresponding to one or more scanning signal lines, and the pattern detection portion detects a display pattern in which display tone values change regularly every row for which the polarity inversion is performed by the video signal line driver circuit.

In a fourth aspect of the present invention, based on the third aspect of the invention, the video signal line driver circuit performs drive such that the video signals transmitted to the pixel forming portions are inverted in polarity every one or more columns corresponding to one or more video signal lines, and the pattern detection portion detects a display pattern in which display tone values change regularly every row and column for which the polarity inversion is performed by the video signal line driver circuit.

In a fifth aspect of the present invention, based on the fourth aspect of the invention, the luminance change storage portion has stored therein predicted values for luminance changes corresponding to display patterns to be presented alternatingly with predetermined first and second display tone values every row and column for which the polarity inversion is performed by the video signal line driver circuit, and the pattern detection portion detects a display pattern to be presented alternatingly with the first display tone values or neighborhood values thereof and the second display tone values or neighborhood values thereof every row and column for which the polarity inversion is performed by the video signal line driver circuit.

In a sixth aspect of the present invention, based on the first aspect of the invention, the backlight drive circuit performs control such that an operation of turning on and then off the light source within a time period shorter than 1/60 of a second is performed once or more during the hold off period.

In a seventh aspect of the present invention, based on the sixth aspect of the invention, the backlight drive circuit performs control such that an operation of turning on and then off the light source so as to be kept off for a time period longer than a time period that extends from the time of turning on to the following turning off is performed once or more.

In an eighth aspect of the present invention, based on the first aspect of the invention, the backlight drive circuit performs control such that the light source is off during the scanning period.

In a ninth aspect of the present invention, based on the eighth aspect of the invention, the backlight drive circuit performs control such that the light source is maintained in off state for a predetermined time period immediately after completion of the scanning period.

In a tenth aspect of the present invention, based on the second aspect of the invention, the backlight drive circuit divides an input image into a plurality of areas, and obtains emission luminance data indicating emission luminance of the light source for each of the areas, on the basis of the input image, the video signal line driver circuit determines potentials of the video signals to be transmitted, on the basis of the emission luminance data, the pattern detection portion detects the display pattern for each of the areas, and the backlight drive circuit calculates and controls the emission luminance of the light source for each of the areas including a display pattern determined as a match by the pattern detection portion, on the basis of predicted values stored in the luminance change portion and corresponding to the display pattern determined as the match.

In an eleventh aspect of the present invention, based on the first aspect of the invention, each of the pixel forming portions includes a thin-film transistor that is rendered conductive or non-conductive in accordance with a signal applied to a scanning signal line connected thereto, a pixel electrode connected to the video signal line via the thin-film transistor, a common electrode provided commonly for the pixel forming portions, pixel capacitance created by the pixel electrode and the common electrode, and a liquid crystal element for displaying a pixel with a display tone corresponding to a voltage held in the pixel capacitance, and the thin-film transistor includes a semiconductor layer made of an oxide semiconductor.

A twelfth aspect of the present invention is directed to a method for driving an active-matrix display device provided with a backlight including a light source, a plurality of pixel forming portions for forming an image to be displayed by transmitting light from the light source, a plurality of video signal lines for transmitting a plurality of video signals representing the image to be displayed to the pixel forming portions, and a plurality of scanning signal lines crossing the video signal lines, the pixel forming portions being arranged in a matrix so as to be associated with the video signal lines and the scanning signal lines, the method comprising:

a scanning signal line drive step of selectively driving the scanning signal lines during a predetermined scanning period and deselecting all of the scanning signal lines during a hold off period starting upon completion of the scanning period, the scanning period and the hold off period constituting a frame period longer than 1/60 of a second;

a video signal line drive step of providing the video signal lines with the video signals to be transmitted, during the scanning period; and a backlight drive step of controlling the light source included in the backlight so as to be turned on/off, wherein, in the backlight drive step, emission luminance of the light source is calculated on the basis of prestored predicted values for luminance changes in an image to be displayed by the pixel forming portions during the hold off period, and the light source is controlled so as to be turned on with the calculated emission luminance, thereby compensating for the luminance changes.

Effect of the Invention

In accordance with the first aspect of the invention, the light source luminance of the backlight is controlled so as to change (typically, in the opposite phase relative to luminance changes), on the basis of the predicted values prestored in the luminance change storage portion, thereby compensating for luminance changes due to potential fluctuations of the pixel electrodes caused by current leakage, data writing, and drawing. As a result, it is possible to reduce or eliminate both flicker due to current leakage and flicker due to data writing and drawing in a display device for which the scanning period and the hold off period (the scan stop period) are set.

In accordance with the second aspect of the invention, a display pattern (typically, an anti-flicker pattern) prestored in the pattern detection portion is detected in order to compensate for luminance changes, and with such a display pattern, the amount of change in luminance increases, making it possible to further reduce or eliminate flicker as above.

In accordance with the third aspect of the invention, when the video signal line driver circuit performs inversion drive by an n-line inversion drive scheme (where n is an integer of 1 or more), the pattern detection portion detects a display pattern (anti-flicker pattern) in which inversion occurs every n rows. As a result, it is possible to compensate for luminance changes using an anti-flicker pattern by which to maximize the amount of change in luminance, making it possible to further reduce or eliminate flicker as above.

In accordance with the fourth aspect of the invention, when the video signal line driver circuit performs inversion drive by a drive scheme (dot inversion drive scheme) in which inversion occurs every n rows and also every m columns (where m is an integer of 1 or more), the pattern detection portion detects a display pattern (anti-flicker pattern) in which inversion occurs every n rows and also every m columns. As a result, it is possible to compensate for luminance changes using an anti-flicker pattern by which to maximize the amount of change in luminance, making it possible to further reduce or eliminate flicker as above.

In accordance with the fifth aspect of the invention, when the video signal line driver circuit performs inversion drive using a dot inversion drive scheme, the pattern detection portion detects an anti-flicker pattern and a pattern with pixels whose values are similar to the pixel values in the anti-flicker pattern. As a result, it is possible to compensate for luminance changes using an anti-flicker pattern by which to maximize the amount of change in luminance and also a display pattern similar to the anti-flicker pattern, by which to relatively increase the amount of change in luminance, making it possible to further reduce or eliminate flicker as above.

In accordance with the sixth aspect of the invention, the light source is caused to blink on and off once or more within a time period shorter than 1/60 of a second during the hold off period, thereby reducing flicker as above while preventing occurrence of flicker caused by the light source of the backlight blinking on and off.

In accordance with the seventh aspect of the invention, the operation of keeping the light source of the backlight off for a longer time period than it is kept on is performed once or more, and therefore, it is necessary to achieve the average luminance for sufficient illumination for image display within the on-period shorter than the off period, leading to increased emission luminance of the light source. Thus, the magnitude of the luminance can be controlled with higher accuracy.

In accordance with the eighth aspect of the invention, the light source of the backlight is kept off during the scanning period, and therefore, there is no peak in the luminance changes that would occur, as described above, during the scanning period if the light source were turned on (i.e., no display is provided). As a result, the maximum amount of change in luminance decreases, so that flicker as above can be reduced.

In accordance with the ninth aspect of the invention, the light source is maintained in off state for a predetermined time period immediately after the end of the scanning period, so that there is no luminance peak that would occur, as described above, during the scanning period, more specifically, at the boundary of the scanning period and the following hold off period, if the light source were turned on, and therefore, even in the case where a display image would persist with inappropriate luminance, for example, because the response speed of the liquid crystal is affected by the occurrence of such a luminance peak, such an image can be prevented from being displayed.

In accordance with the tenth aspect of the invention, an input image is divided into a plurality of areas, emission luminance data, which indicates emission luminance of the light source for each area, is obtained, a display pattern is detected for each area by pattern detection, the emission luminance of the light source is calculated and controlled for each area that includes a display pattern determined as a match by the pattern detection portion, on the basis of predicted values corresponding to a display pattern determined as a match, and therefore, flicker as above can be reduced or eliminated even in a portion of the image.

In accordance with the eleventh aspect of the invention, an oxide semiconductor is used for the semiconductor layers of the thin-film transistors, and therefore, current leakage can be kept extremely low, making it possible to significantly reduce power consumption and also reduce or eliminate flicker.

The twelfth aspect of the invention renders it possible for a display device drive method to achieve similar effects to those achieved by the first aspect of the invention.

MODES FOR CARRYING OUT THE INVENTION

Hereinafter, embodiments of the present invention will be described with reference to the accompanying drawings.

1. First Embodiment

Figure 1:
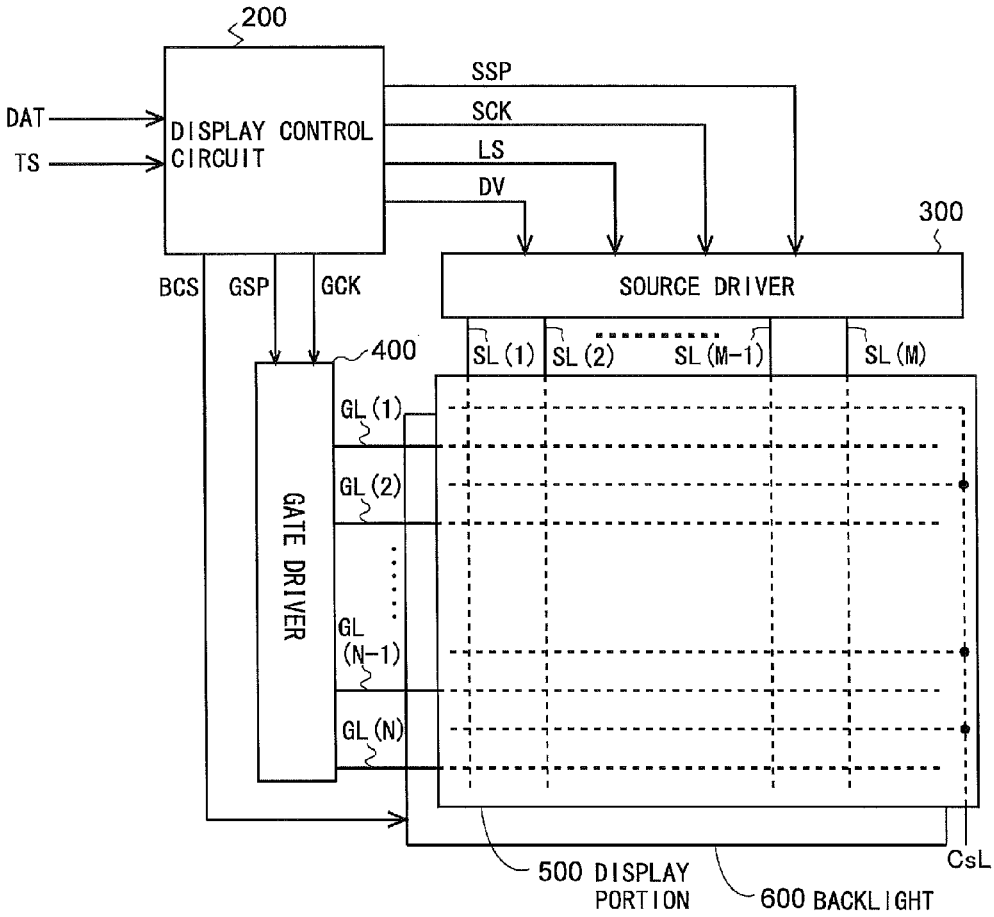
FIG. 1 is a block diagram illustrating the overall configuration of an active-matrix liquid crystal display device according to an embodiment of the present invention.

1.1 Overall Configuration and Operation of the Liquid Crystal Display Device FIG. 1 is a block diagram illustrating the overall configuration of an active-matrix liquid crystal display device according to an embodiment of the present invention. This liquid crystal display device includes a drive control portion, which consists of a display control circuit 200, a source driver circuit (video signal line driver circuit) 300, and a gate driver circuit (scanning signal line driver circuit) 400, a display portion 500, and a backlight 600. The display portion 500 includes a plurality (M) of video signal lines SL(1) to SL(M), a plurality (N) of scanning signal lines GL(1) to GL(N), and a plurality (M×N) of pixel forming portions provided along the video signal lines SL(1) to SL(M) and the scanning signal lines GL(1) to GL(N).

The display portion 500 is configured in normally white mode with a TN (Twisted Nematic) orientation structure employing a dot inversion drive scheme, but this is only illustrative, and another orientation structure and a line inversion drive scheme may be employed.

Figure 2:
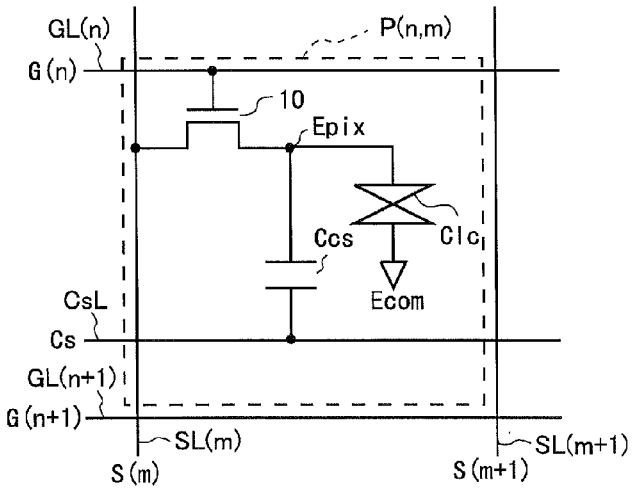
FIG. 2 is a circuit diagram illustrating an equivalent circuit of a pixel forming portion in the embodiment.

In the following, the pixel forming portion provided near the intersection of the scanning signal line GL(n) and the video signal line SL(m) (in the figure, near and to the lower right of the intersection) in association with that intersection is denoted by reference symbol "P(n,m)". FIG. 2 illustrates an equivalent circuit of the pixel forming portion P(n,m) of the display portion 500 in the present embodiment.

As shown in FIG. 2, the pixel forming portion P(n,m) is configured by a TFT 10, which is a switching element having a gate terminal connected to the scanning signal line GL(n) and a source terminal connected to the video signal line SL(m) passing through the intersection, a pixel electrode Epix connected to a drain terminal of the TFT 10, a common electrode Ecom commonly provided for the pixel forming portions P(i,j) (where i=1 to N, and j=1 to M), and a liquid crystal layer, which is an electro-optic element commonly provided for the pixel forming portions P(i,j) (where i=1 to N, and j=1 to M) between the pixel electrode Epix and the common electrode Ecom.

In the present embodiment, the TFT 10 has a semiconductor layer made of an oxide semiconductor that offers a relatively high-speed response and provides extremely low current leakage, typically, an In—Ga—Zn—O (IGZO) based oxide semiconductor. In the case where high-speed response and low current leakage are less demanded, amorphous silicon, which can be produced readily at low cost, may be used as the semiconductor layer, and other well-known materials such as continuous grain silicon can be used as well.

Note that each pixel forming portion P(n,m) displays one of the colors red (R), green (G), and blue (B), and the pixel forming portions P(n,m) that display the same color are arranged along the video signal lines SL(1) to SL(M), such that R, G, and B are sequentially repeated in the direction along the scanning signal lines GL(1) to GL(N), as shown in FIG. 2.

The pixel forming portion P(n,m) has liquid crystal capacitance (also referred to as "pixel capacitance") Clc created by the pixel electrode Epix and the common electrode Ecom opposed thereto with respect to the liquid crystal layer. There are two video signal lines SL(m) and SL(m+1) provided near the pixel electrode Epix, and the video signal line SL(m) is connected to the pixel electrode Epix via the TFT 10. In this manner, there is parasitic capacitance between the pixel electrode Epix of any individual pixel forming portion and the video signal line SL(m+1) adjacent thereto, and also between the pixel electrode Epix and two scanning signal lines GL(n) and GL(n+1) adjacent thereto. Moreover, an auxiliary capacitance line CsL is formed in parallel with the scanning signal line GL(n), so that auxiliary capacitance Ccs is created between the pixel electrode Epix and the auxiliary capacitance line CsL in the pixel forming portion P(n,m). Note that all capacitance created between the pixel electrode Epix and other electrodes in one pixel forming portion P(n,m) (i.e., all capacitance coupled to the pixel electrode Epix) will also be referred to as pixel capacitance.

The display control circuit 200 receives a display data signal DAT and a timing control signal TS, which are transmitted externally, and outputs digital image signals DV, signals for controlling the timing of displaying an image on the display portion 500, including a source start pulse signal SSP, a source clock signal SCK, a latch strobe signal LS, a gate start pulse signal GSP, and a gate clock signal GCK, as well as a backlight control signal BCS for controlling the switching on and off of the backlight 600.

The gate driver circuit 400 sequentially applies active scanning signals G(1) to G(N) to the scanning signal lines GL(1) to GL(N) on the basis of the gate start pulse signal GSP and the gate clock signal GCK outputted by the display control circuit 200.

Furthermore, the gate driver circuit 400 applies a predetermined potential simultaneously to the scanning signal lines GL(1) to GL(N) during a hold off period (scan stop period) to be described later. So long as the potential is not any of the active scanning signals G(1) to G(N), i.e., so long as it deselects the scanning signal lines, the potential may be a non-active scanning signal potential to be provided to each of the scanning signal lines GL(1) to GL(N) in unselected state during the scanning period or may be a predetermined and well-known constant potential such as a common electrode potential. Moreover, the source driver circuit 300 similarly applies a predetermined potential (different from or the same as the aforementioned potential) simultaneously to the video signal lines SL(1) to SL(M) during the hold off period to be described later. The operations of the circuits during the hold off period will be described later.

The source driver circuit 300 receives the digital image signals DV, the source start pulse signal SSP, the source clock signal SCK, and the latch strobe signal LS outputted by the display control circuit 200, and applies drive video signals S(1) to S(M) to the video signal lines SL(1) to SL(M) in order to charge pixel capacitance (liquid crystal capacitance Clc and auxiliary capacitance Ccs) in the pixel forming portions P(n,m) in the display portion 500. At this time, the source driver circuit 300 sequentially holds the digital image signals DV, which specify voltages to be applied to the video signal lines SL(1) to SL(M), in accordance with the timing of the pulsing of the source clock signal SCK. In addition, the digital image signals DV being held are converted into analog voltages in accordance with the timing of the pulsing of the latch strobe signal LS. Such D/A conversion is performed by a gray-level voltage generation circuit. The gray-level voltage generation circuit generates analog voltages corresponding to display tones, for example, by dividing a reference voltage provided from outside of the source driver circuit 300 in order to generate gray-level voltages. The analog voltages generated by the gray-level voltage generation circuit are applied concurrently to all of the video signal lines SL(1) to SL(M) as drive video signals. That is, in the present embodiment, line-sequential drive is employed as a method for driving the video signal lines SL(1) to SL(M).

Figure 3:
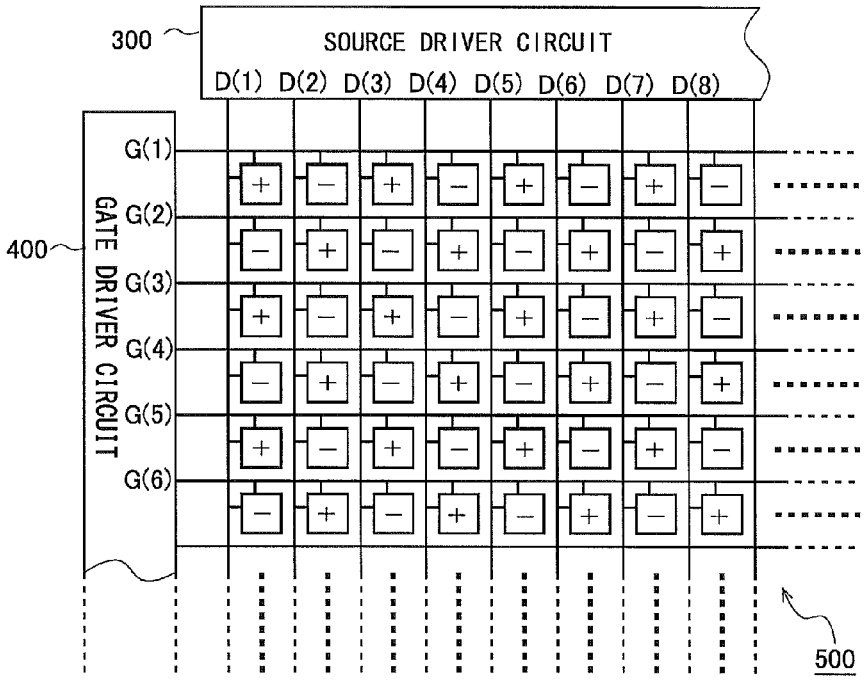
FIG. 3 is a diagram showing the polarities of pixel forming portions in the embodiment by way of example.

Here, the polarities of the drive video signals S(1) to S(M) applied to the video signal lines SL(1) to SL(M) are inverted every row and also every column as described earlier. For example, the polarities of the drive video signals S(1) to S(M) when an active scanning signal G(1) is being applied to the scanning signal line GL(1) are opposite to those when an active scanning signal G(2) is being applied to the scanning signal line GL(2), and the even video signal lines SL(2), SL(4), . . . , SL(M) from among the drive video signals S(1) to S(M) are opposite in polarity to the odd video signal lines SL(1), SL(3), . . . , SL(M−1). Note that a signal that specifies the timing of such polarity inversion is not illustrated in the figure, but it is generated by the display control circuit 200 and provided to the source driver circuit 300. Such configuration realizes dot inversion drive. In this dot inversion drive scheme, the polarities of the voltages applied to the pixel forming portions P(n,m) and held in the pixel capacitance vary column-by-column within the same row, and also row-by-row within the same column, as shown in FIG. 3, and therefore, the aforementioned flicker due to peak-to-peak asymmetry is spatially averaged and thereby eliminated or reduced.

In this manner, the drive video signals are applied to the video signal lines SL(1) to SL(M), and the scanning signals are applied to the scanning signal lines GL(1) to GL(N), so that the display portion 500 displays an image. Note that the common electrode Ecom and the auxiliary capacitance lines CsL are supplied with predetermined voltages by an unillustrated power circuit, and maintained at the same potentials.

However, two adjacent frames are opposite in the direction of luminance change due to data writing and drawing, and in the case where a specific display pattern (anti-flicker pattern) as mentioned above, such as a checkered pattern, is presented during dot inversion drive, the spatial luminance averaging as mentioned above is not performed, so that flicker can become more recognizable.

Figure 4:
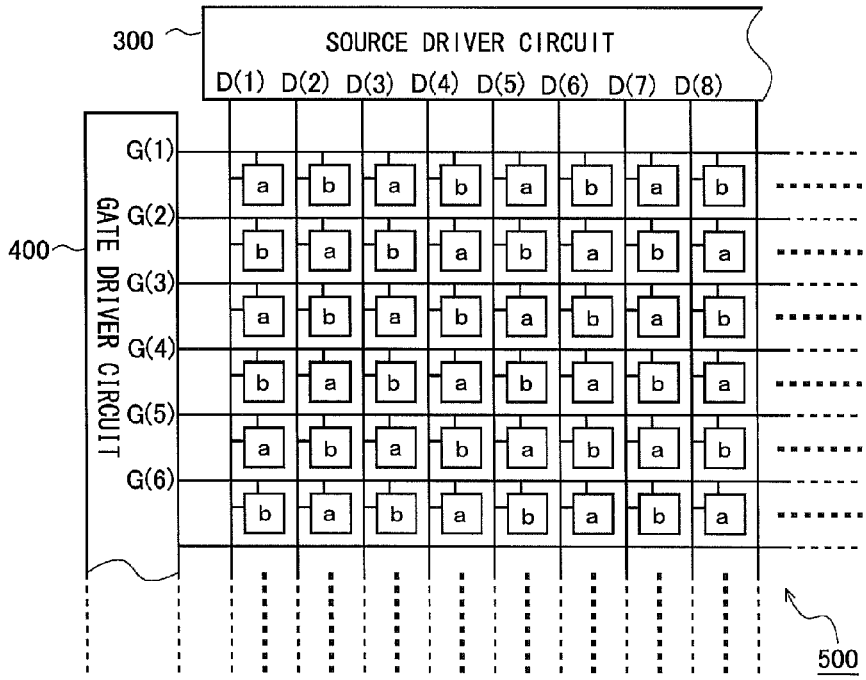
FIG. 4 is a diagram describing an anti-flicker pattern in the embodiment.

FIG. 4 is a diagram describing the anti-flicker pattern. The letters a and b shown in FIG. 4 denote values of pixels displayed by the pixel forming portions during a certain frame; typically, a=0 (black tone), and b=127 (intermediate tone). Note that each pixel forming portion displays one of the three primary colors (R, G, and B), and the tone value as above indicates the display tone in its corresponding color.

As can be appreciated by comparing the anti-flicker pattern shown in FIG. 4 with the status of polarity inversion shown in FIG. 3, the polarities of the voltages held in the pixel capacitance of the pixel forming portions that provide intermediate-tone display are all negative during the frame. Accordingly, the spatial luminance averaging is not performed at all, so that when all of the polarities of the voltages held in the pixel capacitance of the pixel forming portions that provide intermediate-tone display change to positive in the next frame, there arises a difference in the average display luminance between the two frames. More specifically, the potentials held in the pixel capacitance fluctuate because of data writing, drawing, etc., change in the pixel forming portions in opposite directions between the two frames, so that the average display luminance on the screen changes, and therefore, flicker can be visually recognized. Note that unless the values a and b are equal, the spatial luminance averaging is not performed because of the anti-flicker pattern, and in this case, the aforementioned luminance change occurs, but flicker becomes most recognizable when the anti-flicker pattern is such that one of two adjacent pixel forming portions provides black-tone or white-tone display and the other provides intermediate-tone display. Therefore, in the case where the anti-flicker pattern is displayed, the display control circuit 200 causes the backlight 600 to blink on and off in order to provide appropriate lighting, thereby reducing the aforementioned flicker. The features of the display control circuit 200 that perform the operation of detecting an anti-flicker pattern will now be described with reference to FIG. 5.

1.2 Display Control Circuit

Figure 5:
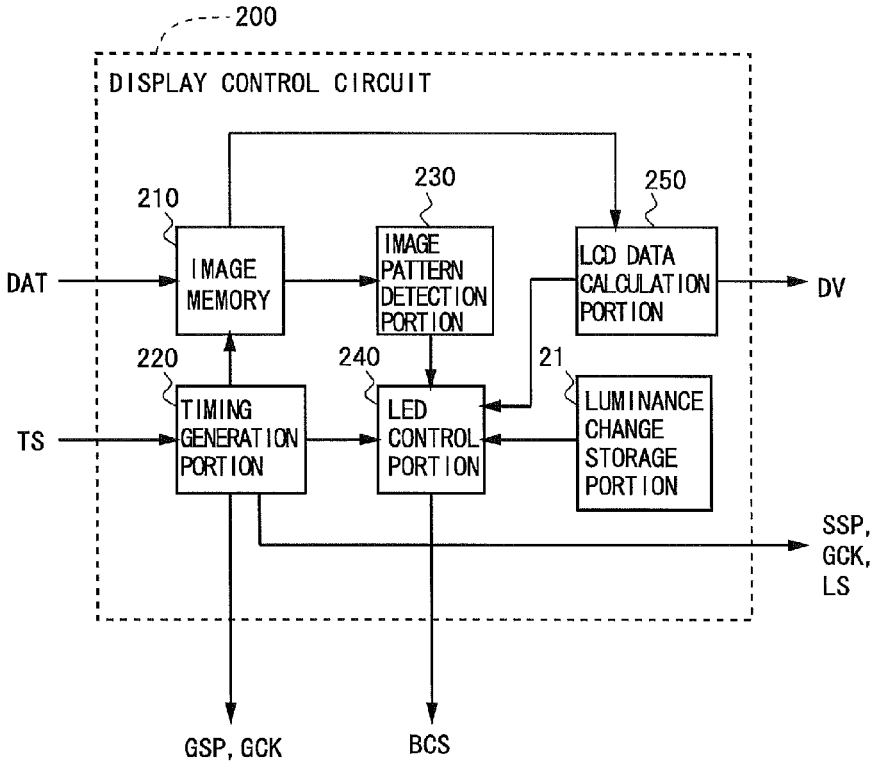
FIG. 5 is a block diagram illustrating in detail the configuration of a display control circuit in the embodiment.

FIG. 5 is a block diagram illustrating in detail the configuration of the display control circuit 200 in the present embodiment. The display control circuit 200 shown in FIG. 5 includes image memory 210, a timing generation portion 220, an image pattern detection portion 230, an LED control portion 240, an LCD data calculation portion 250, and a luminance change storage portion 21.

The display control circuit 200 receives display data DAT from an external video source, and image data DA is written to the image memory 210; a timing control signal TS is written to an unillustrated register and thereafter provided to the timing generation portion 220.

The timing generation portion (abbreviated below as "TG") 220 generates a source clock signal SCK, a source start pulse signal SSP, a gate clock signal GCK, a gate start pulse signal GSP, and other timing signals on the basis of the timing control signal TS held in the register.

The operation of the image memory 210 is controlled by an unillustrated memory control circuit. Under this control, the image memory 210 appropriately reads a digital image signal representing an image to be displayed on the display portion 500, and provides the signal to the LCD data calculation portion 250. The LCD data calculation portion 250 appropriately corrects image data, and thereafter, the LCD data calculation portion 250 calculates backlight luminance required for an image to be displayed in one frame, and provides it to the LED control portion 240. The corrected LCD data is outputted from the display control circuit 200 as digital image signals DV. The digital image signals DV are supplied to the source driver circuit 300, as has already been described.

The image pattern detection portion 230 receives the image data to be displayed from the image memory 210, and detects whether or not the image data is an anti-flicker pattern as described above. Various well-known methods can be applied to such detection; for example, a tone value is detected for each pixel (here, a subpixel for displaying a primary color) in the display image in order to detect if pixel arrays correspond to the anti-flicker pattern. In the pixel arrays, typically, black or white tones and intermediate tones are repeated vertically and also horizontally, and all of the pixels are sequentially compared with such a combination to determine if the arrays match the combination. Such a combination of pixel values is stored in the luminance change storage portion 21, and is appropriately read out by the image pattern detection portion 230. Note that the number of matches detected at this time may be stored, so that pixel arrays can be determined to constitute an anti-flicker pattern when the percentage to the total number of detections exceeds a predetermined value (e.g., 90%). Moreover, in the case where the black or white tones and the intermediate tones change only by a predetermined, small tone value such as one level also, the pixel arrays can be considered to approximately correspond to the anti-flicker pattern, and therefore, the above determination is preferably made on the basis of whether the pattern of tone values is within a predetermined range.

Upon reception of a timing signal from the TG 220, which more specifically, indicates an end point (or even a start point) of a scanning period, the LED control portion 240 outputs either a signal to control LED luminance, which has been corrected in a manner as will be described later, or an uncorrected control signal in accordance with the result of determination by the image pattern detection portion 230. The details of luminance control and the control operation by the display control circuit 200 of causing the backlight 600 to blink on and off will be described with reference to FIG. 6.

1.3 Control Operation of the Backlight

Figure 6:
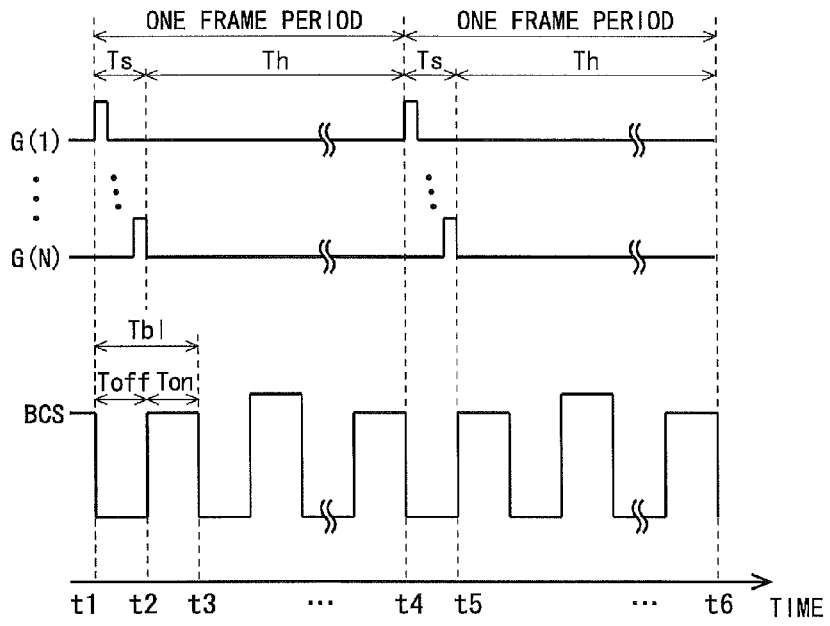
FIG. 6 is a diagram illustrating the timing of scanning signals and a backlight control signal in the embodiment.

FIG. 6 is a diagram illustrating the timing of scanning signals and a backlight control signal in the present embodiment. The gate driver circuit 400 sequentially outputs (active) scanning signals G(1) to G(N) within a scanning period Ts, which extends from time t1 to time t2 during one frame period, as shown in FIG. 6, rather than sequentially outputting active scanning signals G(1) to G(N) during one entire frame period. Note that during the scanning period Ts, the source driver circuit 300 outputs drive video signals S(1) to S(M) to be inverted in polarity every row (in accordance with the line-sequential drive scheme), as described earlier. Moreover, the duration of a period for which each of the scanning signals G(1) to G(N) is kept active is approximately Ts/N, but the figure shows the period with a different duration for the sake of easy viewing.

After the scanning period Ts ends, the scanning signals G(1) to G(N) and the drive video signals S(1) to S(M) are not outputted during a hold off period Th, which is a scan stop period extending from time t2 to time t4, and the scanning signal lines GL(1) to GL(N) and the video signal lines SL(1) to SL(M) are maintained (fixed) at a predetermined potential. After such an operation for one frame period ends, the same operation is performed during the next frame period extending from time t4 to time t6, and is also repeated thereafter.

Note that the scanning period Ts lasts for 1/120 of a second, and the hold off period Th lasts for 239/120 of a second. Accordingly, one frame period lasts for two seconds. These values are merely illustrative, and other well-known values may be employed, but the hold off period Th is set in order to achieve lower power consumption, and normally lasts for a time period preferably greater than the scanning period (typically, several times to hundreds of times longer), and therefore, one frame period is preferably longer than at least 1/60 of a second.

Note that in the case where the TFTs 10 use typical amorphous silicon, providing such a long hold off period results in an excessively large amount of current leakage from the TFTs 10, and therefore, it is often the case that such TFTs are not practically usable. However, in the case where the TFTs 10 use an oxide semiconductor as in the present embodiment, the amount of current leakage is extremely small, and providing a hold off period of about two seconds causes no problems and is preferable. By providing such a long hold off period, it is rendered possible to further reduce power consumption.

Furthermore, as shown in FIG. 6, the backlight control signal BCS outputted by the display control circuit 200 is at low potential from time t1 to time t2, so that the backlight 600 is off. Note that the period that extends from time t1 to time t2 is a scanning period, and therefore, lasts for 1/120 of a second.

Next, during a backlight-on period Ton, which extends from time t2 to time t3, the backlight control signal BCS is at high potential (active potential), so that the backlight 600 is on. The potential of the control signal BCS has a voltage waveform in accordance with the emission luminance during the on-period, as will be described later, and such changes in the potential will be described later although the outline of the changes is omitted in the figure. Note that the backlight-on period Ton lasts for 1/120 of a second.

The following period is a backlight-off period Toff, which lasts for 1/120 of a second, i.e., the same length as the scanning period. Accordingly, a backlight-blinking period Tbl lasts for 1/60 of a second. Note that the backlight control signal BCS is at low potential, so that the backlight 600 is off.

In this manner, the backlight repeats blinking on and off at a frequency of 60 Hz. It is known that such blinking is not recognized as flicker at a frequency of 60 Hz or higher, but at a frequency of less than 60 Hz when the rate (also referred to as the flicker rate) of the average luminance to the maximum amount of change in luminance (=maximum luminance−minimum luminance) is at a predetermined value or more.

Figure 7:
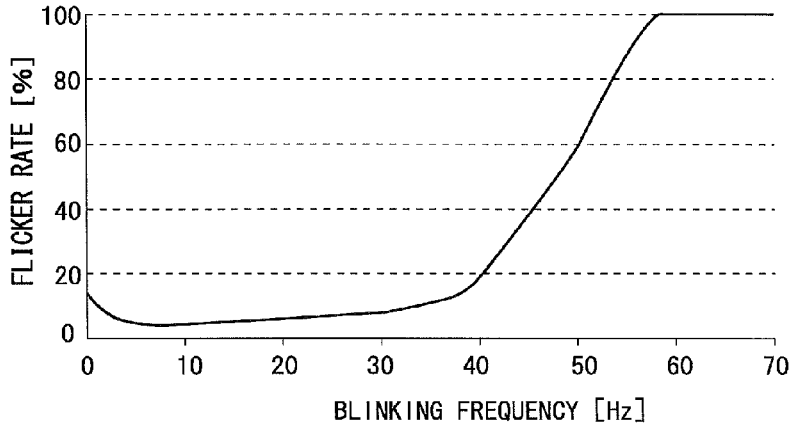
FIG. 7 is a graph showing the relationship between the flicker rate at the limit of perception and the frequency for blinking.

FIG. 7 is a graph showing the relationship between the flicker rate at the limit of perception and the frequency for blinking. The solid line shown in FIG. 7 represents the limit line for flicker perception; flicker is perceivable in the range above the solid line, and not perceivable in the range below the solid line. Referring to FIG. 7, it can be appreciated that flicker is most perceivable around a frequency of 10 Hz, and changes in luminance around a frequency of 0 Hz, e.g., changes in luminance at intervals of several seconds, can be perceived as flicker. Moreover, flicker is not perceivable at a frequency of 60 Hz or higher.

However, even in the case where the backlight repeats blinking on and off at a frequency of 60 Hz, flicker might be perceived if lighting luminance changes cyclically. More specifically, unless the average luminance (or the peak luminance) of the display panel is constant while the backlight is on, flicker might be perceived depending on the cycle of the luminance change. Supposing, for example, that the average luminance of the display panel is A during a certain backlight-on period Ton, B during the next backlight-on period Ton, and also A during the following (i.e., the next but one) backlight-on period Ton. In the case where such luminance changes are repeated (A→B→A→B→ . . . ), the average luminance of the display panel while the backlight is on changes cyclically at 30 Hz. Such luminance changes might be perceived as 30-Hz flicker. Moreover, in the case where the average luminance of the display panel while the backlight is on changes every frame, the average luminance of the display panel changes cyclically at 0.25 Hz over two frame periods. Such luminance changes might be perceived as 0.25-Hz flicker.

Here, as can be appreciated with reference to FIG. 7, there are flicker rates at which flicker is not perceivable even at a frequency of about 10 Hz (the flicker rate at the limit of perception will be referred to as the "limit flicker rate"); by keeping the maximum amount of change in luminance low such that the limit flicker rate is not exceeded, it is rendered possible that flicker is not perceivable regardless of the blinking frequency. In addition, even if the limit flicker rate is exceeded, the lower the maximum amount of change in luminance is kept, the lower the flicker rate becomes, so that flicker can be less perceivable, resulting in reduction of flicker.

In the present embodiment, to keep the maximum amount of change in luminance low, backlight-off periods Toff are set such that the backlight 600 is off during scanning periods Ts (e.g., from time t1 to t2 and from t4 to t5), as shown in FIG. 6. In addition, backlight luminance is controlled such that the average luminance is equal (or similar) between two frames, as will be described later. Described below is the result of such a blinking operation of the backlight being that the maximum amount of change in luminance and changes in the average luminance are suppressed.

1.4 Behavior of Luminance Changes in the Display Portion

Figure 8:
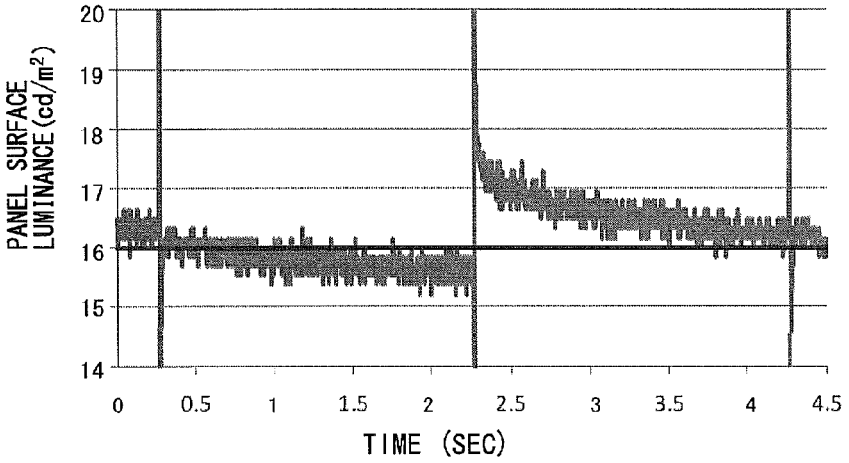
FIG. 8 is a graph showing changes in luminance over time observed at the center of a display portion, where a backlight is kept in on state for comparison with the embodiment.

FIG. 8 is a graph showing changes in luminance over time observed at the center of the display portion, where the backlight is kept in on state. Note that unlike during the operation in the present embodiment, the backlight 600 is kept in on state with luminance for solid white display in order to clarify the characteristics of the operation in the present embodiment. Moreover, during the luminance observation, an anti-flicker pattern is displayed with black-tone (gray level 255) and intermediate-tone (gray level 126) display regions arranged in a pixel-by-pixel checkered pattern. By using such a display pattern, the amount of change in the average luminance between two frames is maximized. In FIG. 8, the horizontal axis represents elapsed time, and the vertical axis represents the luminance value on the panel surface.

As shown in FIG. 8, the scanning period Ts of a given frame begins at 0.25 seconds after the start of the measurement (the 0-second mark). The hold off period Th begins after the scanning period Ts, i.e., after 1/120 of a second. After the hold off period Th, i.e., two seconds after the start of the frame, the scanning period Ts of the next frame begins; such an operation as above will be repeated thereafter. By observing display luminance changes resulting from such an operation, it can be appreciated that there is a peak in the luminance changes during the scanning period Ts, more specifically, near the boundary of the scanning period Ts and the hold off period Th.

Such luminance changes occur in accordance with potential fluctuations of the pixel electrodes due to current leakage, data writing, and drawing as described earlier, and for example, the total amount of charge, which is equivalent to the amount of current leakage caused in the pixel forming portions, increases from the start to the end of the hold off period. However, during the scanning period following the hold off period, the video signals applied to the video signal lines are opposite in polarity (to their polarities during the previous frame), so that luminance changes occur in accordance with potential fluctuations due to data writing and drawing. As a result, there occurs a peak in the luminance changes during the scanning period Ts, more specifically, near the boundary of the scanning period Ts and the following hold off period Th, as shown in FIG. 8. However, the amount of change in luminance varies depending on, for example, the potentials of the video signal lines and the scanning signal lines during the hold off period, the difference in effective voltage between pixel electrodes due to data writing and drawing, and the difference in effective voltage between two adjacent frame periods due to polarity inversion drive, and in this case, the luminance is maximized at both the start of the scanning period Ts during the first frame period and the start of the scanning period Ts during the next but one (i.e., one after the next) frame period. As described earlier, such cyclical luminance changes (particularly at the peak of the luminance) might be recognized as flicker.

In the present embodiment, the backlight-off period Toff is set so as to include the scanning period Ts in which the luminance peaks in the above manner. For example, the scanning period Ts is set so as to coincide with the backlight-off period Toff, which extends from time t1 to time t2, as shown in FIG. 6. In this manner, the backlight is turned off near the peak of the luminance, and therefore, the luminance changes are reduced overall, so that flicker can be inhibited.

However, as can be appreciated with reference to FIG. 8, the actual luminance of the display portion, excluding the peak luminance, is mostly greater or lower than a desired average luminance level, and as a result of such luminance changes, flicker might be recognized. Therefore, in the present embodiment, the luminance of the backlight is further controlled such that the luminance changes (in the opposite phase) so as to cancel out the aforementioned changes in luminance. The method for controlling the backlight luminance will be described below with reference to FIG. 9.

Figure 9:
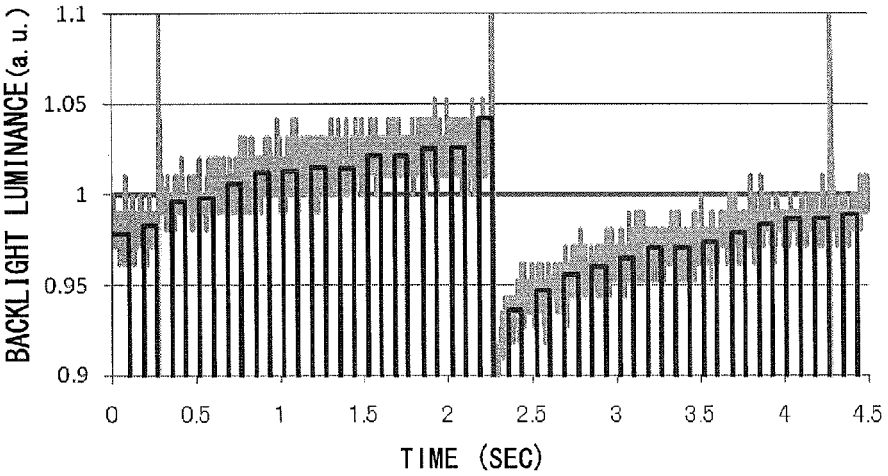
FIG. 9 is a graph describing backlight luminance changes in the embodiment.

FIG. 9 is a graph describing the backlight luminance changes in the present embodiment. The changes in the luminance that are indicated by rectangles in FIG. 9 represent the average luminance levels of the backlight during the backlight-on period Ton, and the changes in the luminance that are indicated by a continuous line zigzagging in the upper portion of the rectangles represent luminance changes inverted (in the opposite phase) relative to the desired luminance value 1, where the backlight shown in FIG. 8 is fixed in on state. In this manner, in FIG. 9, the vertical axis represents the luminance value normalized to 1 where the backlight is maintained in on state, and the horizontal axis represents elapsed time.

Here, given that the actual display luminance changes, for example, because of parasitic capacitance as mentioned earlier, and supposing that the average luminance of the display portion for the actual display affected by such changes is L1, in order to provide display with desired average luminance L, the backlight luminance has to be controlled with a value obtained by multiplying the average luminance L by L/L1.

Here, the circuit configuration and the control mode to continuously control the backlight luminance are complicated, but in actuality, the backlight luminance control is often performed such that the emission luminance of the backlight is changed per unit time, and the luminance is maintained at a constant level during each unit time. Moreover, in this case, since the backlight-off period Toff is set, the backlight luminance has to be controlled using the (Ton+Toff)/Ton−fold value of the value obtained by multiplying the average luminance L by L/L1. Note that the symbol Ton represents the duration of the backlight-on period, and the symbol Toff represents the duration of the backlight-off period. The backlight luminance indicated by the rectangle shown in FIG. 9 is typically calculated in the manner described above. Note that such a backlight luminance calculation method is merely illustrative, and a well-known calculation approach can be suitably employed to obtain the backlight luminance so as to compensate for display luminance changes.

Figure 10:
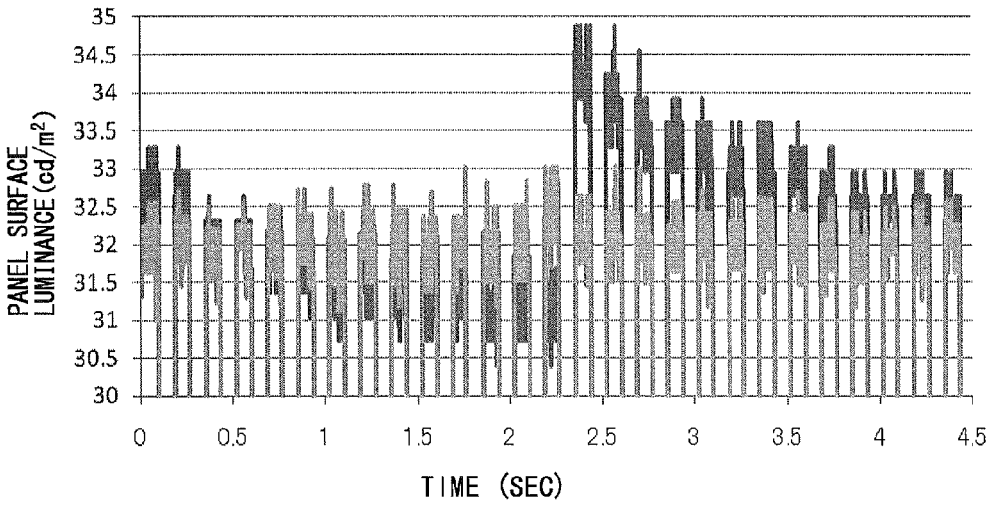
FIG. 10 is a graph showing luminance changes over time observed at the center of the display portion in the present embodiment.

FIG. 10 is a graph showing luminance changes overtime observed at the center of the display portion in the present embodiment. For comparison purposes, FIG. 10 also shows luminance changes of the display portion where the backlight luminance control to compensate for the aforementioned display luminance changes in the present embodiment is not performed, and it can be appreciated that such luminance changes deviate significantly from the ideal luminance value 32 [cd/m$^2$].

On the other hand, it can be appreciated that the display luminance changes in the present embodiment shown in FIG. 10 deviate only about 0.5 [cd/m$^2$] from the ideal luminance value 32 [cd/m$^2$]. Such small changes are lower than the limit flicker rate shown in FIG. 7, and therefore, not recognizable as flicker. Thus, it is possible to eliminate flicker that is recognizable particularly in the case where an anti-flicker pattern is displayed. Moreover, even in the case where a pattern similar to such an anti-flicker pattern is displayed, luminance changes can be suppressed by controlling the backlight in the above manner, so that flicker can be inhibited.

In the present embodiment, (the LED control portion 240 included in) the display control circuit 200 controls the luminance of the backlight after calculating the backlight luminance so as to compensate for luminance changes, as described above. Note that the luminance of the LEDs included in the backlight is proportional to the current that flows therethrough, and therefore, is readily controllable, and the LED configuration is well known and therefore will not be described for individual LEDs.

Note that the luminance changes as above have been described as if the optical response of the liquid crystal is almost negligible, but in the case where fast-response liquid crystal elements, such as ferroelectric or antiferroelectric liquid crystal elements, are not used, the actual luminance changes are delayed from the luminance changes as above in accordance with the optical response time of the liquid crystal elements. Accordingly, the backlight-off period Toff (and the backlight-on period Ton) is preferably set to an appropriate duration in accordance with the actual luminance changes.

1.5 Effects

As described above, in the present embodiment, it is possible to reduce or eliminate both flicker due to current leakage and flicker due to data writing and drawing in a display device for which the scanning period and the scan stop period (hold off period) are set, by controlling the backlight luminance so as to change in the opposite phase relative to luminance changes due to potential fluctuations of pixel electrodes caused by current leakage, data writing, and drawing, in order to compensate for such luminance changes.

Furthermore, the backlight-off period Toff is set so as to coincide with the scanning period Ts, in order to turn off the backlight where the luminance changes peak. As a result, the maximum amount of change in luminance can be kept low, so that both flicker current leakage and flicker due to data writing and drawing can be reduced.

2. Second Embodiment

2.1 Overall Configuration and Operation of the Liquid Crystal Display Device The configuration of the liquid crystal display device in the present embodiment is the same as the configuration of the active-matrix liquid crystal display device in the first embodiment shown in FIG. 1, and therefore, any description thereof will be omitted.

However, in the present embodiment, the backlight-on period Ton is set at 1/240 of a second, which is a half of that in the first embodiment, and the backlight-off period Toff is set at 1/80 of a second, which is three times longer than in the first embodiment. This will be described below with reference to FIG. 11.

2.2 Backlight Control Operation

Figure 11:
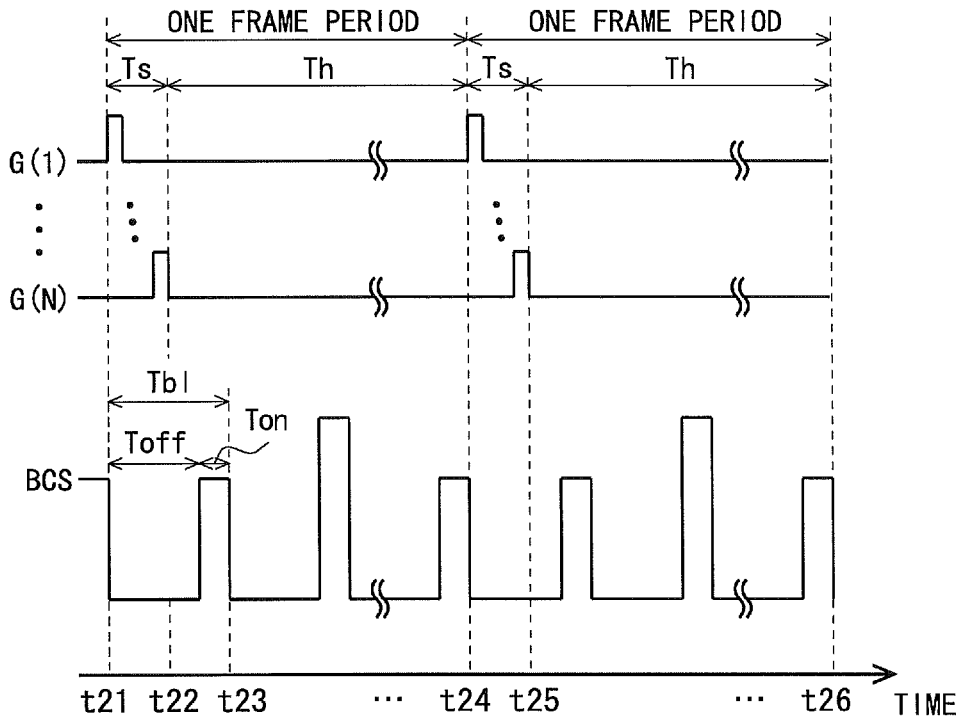
FIG. 11 is a diagram illustrating the timing of scanning signals and a backlight control signal in a second embodiment.

FIG. 11 is a diagram illustrating the timing of scanning signals and a backlight control signal in the present embodiment. As can be appreciated by comparing FIG. 11 with FIG. 6, the scanning period Ts and the hold off period Th in the present embodiment are the same as in the first embodiment, but the backlight-off period Toff is three times longer than in the first embodiment. Accordingly, the backlight luminance during the backlight-on period Ton is required to be increased more than in the first embodiment.

However, as a result of the backlight-off period Toff having been set to such a long duration, the backlight is not turned on for another short period of time (more specifically, for 1/240 of a second) after the end of the scanning period Ts. Therefore, even in the case where a display image persists with inappropriate luminance because of, for example, the response speed of the liquid crystal, such an image can be prevented from being displayed. Moreover, since it is necessary to achieve the average luminance of the illumination that is sufficient for image display within the backlight-on period Ton, which is shorter than (here, one third of) the backlight-off period Toff, the luminance of the backlight source is increased. Thus, the magnitude of the luminance can be controlled with higher accuracy.

2.3 Effects

As described above, in the present embodiment, it is possible to reduce or eliminate both flicker due to current leakage and flicker due to data writing and drawing, as in the first embodiment, and further, even in the case where a display image persists with inappropriate luminance, it is possible to prevent such an image from being displayed.

3. Third Embodiment

3.1 Overall Configuration and Operation of the Liquid Crystal Display Device The configuration of the liquid crystal display device in the present embodiment is the same as the configuration of the active-matrix liquid crystal display device in the first embodiment shown in FIG. 1, except for the configuration of the backlight, and there is a difference in operation only in that so-called area-active drive is performed, therefore, any descriptions of their similarities will be omitted.

The backlight in the first embodiment is configured in a well-known manner so as to be able to illuminate the back of the liquid crystal panel uniformly, but in the present embodiment, backlights are arranged in a matrix so as to illuminate respectively corresponding predetermined portions of the back of the liquid crystal panel, and control their luminance independently of each other.

In the present liquid crystal display device, the luminance of each R display element is the product of the luminance of red light emitted by the backlight and the light transmittance of the R display element. Light emitted by one red LED is incident on one corresponding area and a plurality of surrounding areas. Accordingly, the luminance of the R display element is the product of the total luminance of light emitted by a plurality of red LEDs and the light transmittance of the R display element. Similarly, the luminance of each G display element is the product of the total luminance of light emitted by a plurality of green LEDs and the light transmittance of the G display element, and the luminance of each B display element is the product of the total luminance of light emitted by a plurality of blue LEDs and the light transmittance of the B display element.

The liquid crystal display device thus configured, in which area-active drive is performed, renders it possible to display an input image on the liquid crystal panel by obtaining preferable liquid crystal data and LED data on the basis of the input image, and controlling the light transmittance of display elements P on the basis of the liquid crystal data as well as the luminance of the LEDs included in the backlights on the basis of the LED data. Moreover, when the luminance of pixels in an area is low, the luminance of the LEDs that correspond to that area is lowered, so that backlight power consumption can be reduced. Moreover, when the luminance of pixels in an area is low, the luminance of the display elements P that correspond to that area is changed between fewer levels, so that image resolution can be enhanced, resulting in improved display image quality. The configuration of a display control circuit in such an area-active drive display device that performs the operation of detecting an anti-flicker pattern as in the above embodiment and compensates for display luminance changes will be described below with reference to FIG. 12.

3.2 Display Control Circuit

Figure 12:
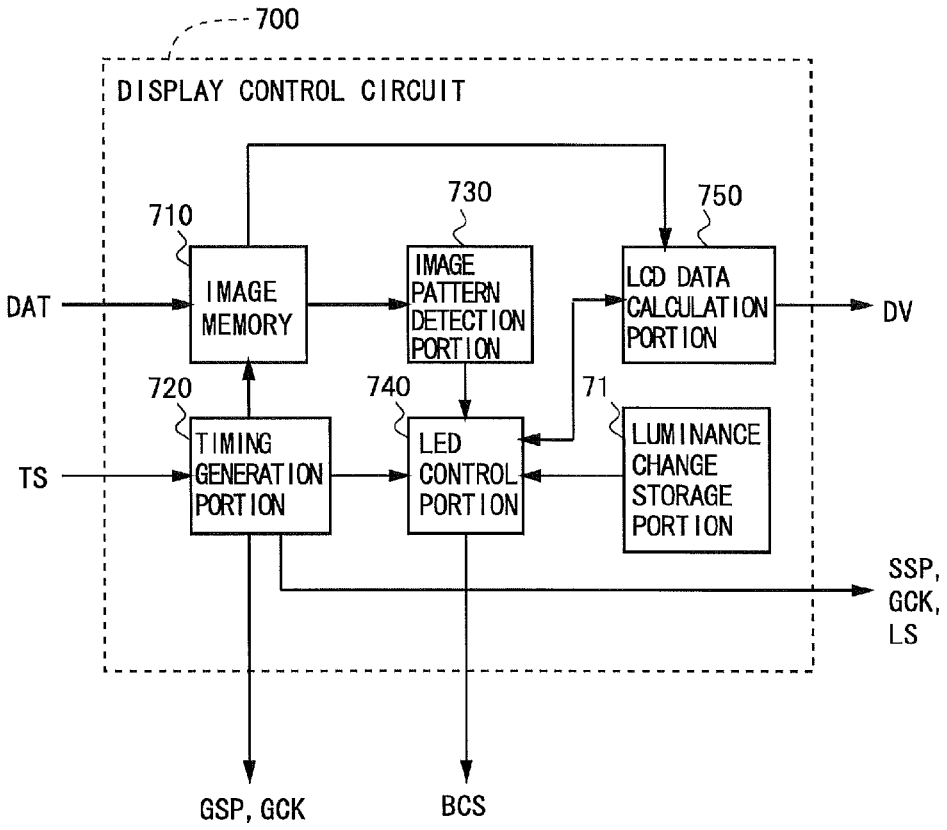
FIG. 12 is a block diagram illustrating in detail the configuration of a display control circuit in a third embodiment.

FIG. 12 is a block diagram illustrating in detail the configuration of the display control circuit 700 in the present embodiment. A display control circuit 700 shown in FIG. 12 includes image memory 710 and a timing generation portion 720, which are similar to those of the display control circuit 200 shown in FIG. 5, as well as an image pattern detection portion 730, an LED control portion 740, an LCD data calculation portion 750, and a luminance change storage portion 71, which operate in slightly different manners from those in the first embodiment to perform area-active drive.

The image pattern detection portion 730 receives image data to be displayed from the image memory 710, and detects whether or not the image data represents an anti-flicker pattern as above, for each area. That is, unlike in the first embodiment, the detection is performed on each portion that corresponds to an area in the image to be displayed. The detection method itself is the same as in the first embodiment. Accordingly, the image pattern detection portion 730 detects a tone value for each pixel (here, a subpixel for displaying a primary color) in a portion of the image that corresponds to the area in the display image, in order to detect if pixel arrays correspond to the anti-flicker pattern. Such a combination of pixel values is stored in the luminance change storage portion 71, and is appropriately read out by the image pattern detection portion 730.

The LED control portion 740 initially divides an input image into a plurality of areas as mentioned above, and obtains LED data (emission luminance data) that indicates the emission luminance of LEDs corresponding to the areas. At this time, the LED control portion 740 refers to PSF data, which is data representing diffusion states of light by numerical values, to calculate display luminance for each area. As a result, the LED data is calculated considering illumination light of adjacent LEDs. Moreover, the LED control portion 740 outputs either a signal which has been corrected in a manner as described above or an uncorrected signal in accordance with the result of determination by the image pattern detection portion 730.

The LCD data calculation portion 750 calculates the display luminance for each area on the basis of the PSF data as well as the LED data calculated for the area by the LED control portion 740, and also calculates liquid crystal data on the basis of the display luminance and the input image, and the liquid crystal panel is provided with the calculated data.

3.3 Effects

As described above, in the present embodiment, the effect of reducing or eliminating both flicker due to current leakage and flicker due to data writing and drawing, as in the first embodiment, can be achieved even in a portion of a display image.

4. Variant

In the above embodiments, an anti-flicker pattern is detected by the image pattern detection portion, and the luminance control as described above is performed only upon detection of an anti-flicker pattern (or a similar pattern), but the luminance control may be performed upon acceptance of an instruction to change modes (e.g., modes for anti-flicker pattern compensation) from outside the display device, rather than upon detection of an anti-flicker pattern from image data.

Furthermore, in the case where an anti-flicker pattern (or a similar pattern) is not included in a part of an image or no such pattern is included at all, there is or there is often no significant difference in average luminance between two frames. However, it is conceivable to always perform the aforementioned luminance control without determining whether an anti-flicker pattern is included or not. In such a configuration, the luminance control might result in flicker contrary to expectation, but by suitably adjusting the amount of charge in luminance for the luminance control, flicker can be suppressed to a certain degree regardless of whether an anti-flicker pattern is included in an image or not.

While the above embodiments have been described with respect to the examples where the dot inversion drive scheme is employed, a line inversion drive scheme may be employed. However, in such a case, the anti-flicker pattern is different from that exemplified in FIG. 4, in that all pixel values in the same row are equal, and pixel values vary between adjacent rows (e.g., rows consisting of black-tone pixels and rows consisting of intermediate-tone pixels alternate with each other). Moreover, a well-known inversion drive mode, such as n-dot inversion drive (where n is an integer of 2 or more) or n-line inversion drive, may be employed as well, and a well-known anti-flicker pattern may be employed as well, e.g., pixel values change every n rows.

In the above embodiments, the backlight is off during the scanning period Ts, but the backlight may be on during a part or all of the period. In this configuration, the maximum luminance change during the scanning period Ts cannot be overcome partially or completely by keeping the backlight off, so that there remains a possibility that flicker might occur. However, at least flicker due to a change in average luminance between two frames can be inhibited, resulting in overall flicker suppression.

In the above embodiments, the oxide semiconductor is used in the TFTs 10 in order not to cause flicker due to current leakage even when a long hold off period is set, but a configuration that uses a semiconductor other than the oxide semiconductor, which has extremely low current leakage or another well-known configuration for preventing flicker due to current leakage may be employed. As a result, it is possible to reduce or eliminate both flicker due to current leakage and flicker due to data writing and drawing.

While the foregoing has been provided taking the active-matrix liquid crystal display device as an example, the present invention can also be applied to any display devices besides liquid crystal display devices, so long as they are based on active-matrix voltage control, include backlight illumination devices, and have scanning periods and hold off periods.

INDUSTRIAL APPLICABILITY

The present invention is applied to active-matrix display devices including backlight illumination devices that can be controlled so as to blink on and off, and is particularly suitable for voltage-controlled display devices such as liquid crystal display devices.

DESCRIPTION OF THE REFERENCE CHARACTERS

10 TFT (switching element)
21, 71 luminance change storage portion
200 display control circuit
210, 710 image memory
220, 720 timing generation portion
230, 730 image pattern detection portion
240, 740 LED control portion
250, 750 LCD data calculation portion
300 source driver circuit
400 gate driver circuit
500 display portion
600 backlight
DAT display data signal (image signal)
DV digital image signal
BCS backlight control signal
Clc liquid crystal capacitance (pixel capacitance)
Ccs auxiliary capacitance
Csda, Csdb parasitic capacitance
Ecom common electrode
Epix pixel electrode
GL(n) scanning signal line (n=1 to N)
SL(m) data signal line (m=1 to M)
P(n,m) pixel forming portion (n=1 to N, m=1 to M)

The invention claimed is:

1. An active-matrix display device provided with a backlight including a light source, a plurality of pixel forming portions for forming an image to be displayed by transmitting light from the light source, a plurality of video signal lines for transmitting a plurality of video signals representing the image to be displayed to the pixel forming portions, and a plurality of scanning signal lines crossing the video signal lines, the pixel forming portions being arranged in a matrix so as to be associated with the video signal lines and the scanning signal lines, the device comprising:

a scanning signal line driver circuit for selectively driving the scanning signal lines during a predetermined scanning period and deselecting all of the scanning signal lines during a hold off period starting upon completion of the scanning period, the scanning period and the hold off period constituting a frame period longer than 1/60 of a second;

a video signal line driver circuit for providing the video signal lines with the video signals to be transmitted, during the scanning period;

a backlight drive circuit for controlling the light source included in the backlight so as to be turned on/off multiple times during the hold off period; and a luminance change storage portion having prestored therein predicted values for luminance changes due to current leakage in an image displayed by the pixel forming portions during the hold off period, wherein, the backlight drive circuit calculates emission luminance of the light source multiple times during the hold off period on the basis of the predicted values stored in the luminance change storage portion, and controls the light source so as to be turned on with the calculated emission luminance, thereby compensating for the luminance changes.

2. The display device according to claim 1, further comprising a pattern detection portion for determining whether or not at least a part of the image matches a prestored display pattern, wherein, the luminance change storage portion has stored therein predicted values for luminance changes corresponding to display patterns detectable by the pattern detection portion, and when the pattern detection portion determines a match, the backlight drive circuit calculates and controls the emission luminance of the light source on the basis of predicted values stored in the luminance change portion and corresponding to a display pattern determined as the match.

3. The display device according to claim 2, wherein, the video signal line driver circuit performs drive such that the video signals transmitted to the pixel forming portions are inverted in polarity every frame period and also every one or more rows corresponding to one or more scanning signal lines, and the pattern detection portion detects a display pattern in which display tone values change regularly every row for which the polarity inversion is performed by the video signal line driver circuit.

4. The display device according to claim 3, wherein, the video signal line driver circuit performs drive such that the video signals transmitted to the pixel forming portions are inverted in polarity every one or more columns corresponding to one or more video signal lines, and the pattern detection portion detects a display pattern in which display tone values change regularly every row and column for which the polarity inversion is performed by the video signal line driver circuit.

5. The display device according to claim 4, wherein, the luminance change storage portion has stored therein predicted values for luminance changes corresponding to display patterns to be presented alternatingly with predetermined first and second display tone values every row and column for which the polarity inversion is performed by the video signal line driver circuit, and the pattern detection portion detects a display pattern to be presented alternatingly with the first display tone values or neighborhood values thereof and the second display tone values or neighborhood values thereof every row and column for which the polarity inversion is performed by the video signal line driver circuit.

6. The display device according to claim 1, wherein the backlight drive circuit performs control such that an operation of turning on and then off the light source within a time period shorter than 1/60 of a second is performed once or more during the hold off period.

7. The display device according to claim 6, wherein the backlight drive circuit performs control such that an operation of turning on and then off the light source so as to be kept off for a time period longer than a time period that extends from the time of turning on to the following turning off is performed once or more.

8. The display device according to claim 1, wherein the backlight drive circuit performs control such that the light source is off during the scanning period.

9. The display device according to claim 8, wherein the backlight drive circuit performs control such that the light source is maintained in off state for a predetermined time period immediately after completion of the scanning period.

10. The display device according to claim 2, wherein, the backlight drive circuit divides an input image into a plurality of areas, and obtains emission luminance data indicating emission luminance of the light source for each of the areas, on the basis of the input image, the video signal line driver circuit determines potentials of the video signals to be transmitted, on the basis of the emission luminance data, the pattern detection portion detects the display pattern for each of the areas, and the backlight drive circuit calculates and controls the emission luminance of the light source for each of the areas including a display pattern determined as a match by the pattern detection portion, on the basis of predicted values stored in the luminance change portion and corresponding to the display pattern determined as the match.

11. The display device according to claim 1, wherein, each of the pixel forming portions includes:

a thin-film transistor that is rendered conductive or non-conductive in accordance with a signal applied to a scanning signal line connected thereto;

a pixel electrode connected to the video signal line via the thin-film transistor;

a common electrode provided commonly for the pixel forming portions;

pixel capacitance created by the pixel electrode and the common electrode; and a liquid crystal element for displaying a pixel with a display tone corresponding to a voltage held in the pixel capacitance, wherein, the thin-film transistor includes a semiconductor layer made of an oxide semiconductor.

12. A method for driving an active-matrix display device provided with a backlight including a light source, a plurality of pixel forming portions for forming an image to be displayed by transmitting light from the light source, a plurality of video signal lines for transmitting a plurality of video signals representing the image to be displayed to the pixel forming portions, and a plurality of scanning signal lines crossing the video signal lines, the pixel forming portions being arranged in a matrix so as to be associated with the video signal lines and the scanning signal lines, the method comprising:

a scanning signal line drive step of selectively driving the scanning signal lines during a predetermined scanning period and deselecting all of the scanning signal lines during a hold off period starting upon completion of the scanning period, the scanning period and the hold off period constituting a frame period longer than 1/60 of a second;

a video signal line drive step of providing the video signal lines with the video signals to be transmitted, during the scanning period; and a backlight drive step of controlling the light source included in the backlight so as to be turned on/off multiple times during the hold off period, wherein, in the backlight drive step, emission luminance of the light source is calculated multiple times during the hold off period on the basis of prestored predicted values for luminance changes due to current leakage in an image displayed by the pixel forming portions during the hold off period, and the light source is controlled so as to be turned on with the calculated emission luminance, thereby compensating for the luminance changes.

* * * * *